US009783864B2

(12) United States Patent
Andreotti et al.

(10) Patent No.: US 9,783,864 B2
(45) Date of Patent: Oct. 10, 2017

(54) SYSTEM FOR THERMAL TREATMENT OF RAILS

(71) Applicant: PRIMETALS TECHNOLOGIES ITALY S.R.L., Marnate (VA) (IT)

(72) Inventors: Simone Andreotti, Marnate (IT); Davide Crespi, Busto Arsizio (IT); Alberto Gioachino Lainati, Saronno (IT); Stefano Roselli, Milan (IT)

(73) Assignee: Primetals Technologies Italy S.R.L., Marnate (VA) (IT)

( * ) Notice: Subject to any disclaimer, the term of this patent is extended or adjusted under 35 U.S.C. 154(b) by 97 days.

(21) Appl. No.: 14/779,085

(22) PCT Filed: Jan. 30, 2014

(86) PCT No.: PCT/EP2014/051826

§ 371 (c)(1),
(2) Date: Sep. 22, 2015

(87) PCT Pub. No.: WO2014/146815

PCT Pub. Date: Sep. 25, 2014

(65) Prior Publication Data

US 2016/0047009 A1 Feb. 18, 2016

(30) Foreign Application Priority Data

Mar. 22, 2013 (EP) ..... 13425044

(51) Int. Cl.

| | |
|---|---|
| ***C21D 9/04*** | (2006.01) |
| ***C21D 1/667*** | (2006.01) |
| ***B05B 1/14*** | (2006.01) |
| ***B05B 13/02*** | (2006.01) |
| ***C22C 38/00*** | (2006.01) |

(Continued)

(52) U.S. Cl.

CPC ..... *C21D 1/667* (2013.01); *B05B 1/14* (2013.01); *B05B 13/0214* (2013.01); *C21D 9/04* (2013.01); *C22C 38/00* (2013.01); *B21B 2045/0221* (2013.01); *C21D 1/60* (2013.01)

(58) Field of Classification Search

CPC ..... C21D 1/667; C21D 9/04
USPC ..... 266/114
See application file for complete search history.

(56) References Cited

U.S. PATENT DOCUMENTS 3,276,924 A * 10/1966 Okamoto ..... C21D 9/06 148/569
3,556,499 A 1/1971 Hammon
4,913,747 A 4/1990 Fukuda et al.

(Continued)

FOREIGN PATENT DOCUMENTS

BE 896346 A1 9/1983
JP S5331011 U 3/1978

(Continued)

*Primary Examiner* — Scott Kastler
(74) *Attorney, Agent, or Firm* — Laurence A. Greenberg; Werner H. Stemer; Ralph E. Locher

(57) ABSTRACT

A system thermally treats rails. The system has a cooling device for spraying a cooling medium onto a rail to be treated. The cooling device defines a cooling path for receiving the rail to be treated. A conveyor moves the rail to be thermally treated through the cooling path. A vertically displacing device for displacing at least one of the cooling devices for adjusting a position of the one cooling device relative to the rail to be treated.

14 Claims, 9 Drawing Sheets

(51) Int. Cl.
*C21D 1/60* (2006.01)
*B21B 45/02* (2006.01)

(56) References Cited

U.S. PATENT DOCUMENTS

| | | | | |
|---|---|---|---|---|
| 6,432,230 | B1 | 8/2002 | Kock et al. | |
| 2003/0047852 | A1 | 3/2003 | Kock et al. | |
| 2016/0047009 | A1* | 2/2016 | Andreotti | C22C 38/00 266/114 |

FOREIGN PATENT DOCUMENTS

| | | | |
|---|---|---|---|
| JP | S6020309 | U | 2/1985 |
| JP | S61149436 | A | 7/1986 |
| JP | S63293115 | A | 11/1988 |
| JP | 6487719 | S | 3/1989 |
| JP | 01104720 | A | 4/1989 |
| KR | 1019900002195 | B1 | 4/1990 |
| RU | 2275434 | C2 | 4/2006 |
| RU | 2279490 | C2 | 7/2006 |
| SU | 1801129 | A3 | 3/1993 |

* cited by examiner

SYSTEM FOR THERMAL TREATMENT OF RAILS

BACKGROUND OF THE INVENTION

Field of the Invention

The invention relates to a system for thermal treatments of rails.

Nowadays, the rapid rise in weight and speed of trains, has inevitably forced to enhance the rails wear rate, in terms of loss of material due to the rolling/sliding between wheel and rail, and therefore an increasing of hardness has been required in order to reduce wear.

Generally, the final characteristics of a steel rail in terms of geometrical profiles and mechanical properties are obtained through a sequence of a thermo-mechanical process: a hot rail rolling process followed by a thermal treatment and a straightening step.

The hot rolling process profiles the final product according to the designed geometrical shape and provides the pre-required metallurgical microstructure for the following treatment. In particular, this step allows the achievement of the fine microstructure which, through the following treatments, will guarantee the high level of requested mechanical properties.

Up to now the systems for thermal treatment of rails are of four different types:

- immersion into a water tank of the rail head by tilting the rail grabbed by its foot,
- spraying of water only,
- spraying of air only,
- spraying air/water mist.

Document U.S. Pat. No. 6,432,230 discloses a device for hardening a rail. The solution presented in this document proposes to fix the rail to be cooled and to cool this rail with a cooling liquid.

In this document, an immersion system is presented that cannot allow flexibility of the cooling process.

Furthermore, this solution can be applied only when the rail can be clamped which is not always the best situation for thermal treatments.

Additionally, existing spraying devices locally cool the rail using water only or air only or a mixture of air and water. However, there is no solution to easily and quickly interchange a system spraying a given type of cooling medium with another system able to spray a different type of cooling medium. The existing spraying based system usually does not allow an easy and precise positioning of the spraying nozzles considering the variability of the possible rail profiles to be treated.

BRIEF SUMMARY OF THE INVENTION

A major objective of the present invention is to propose a system for thermal treatment of rails that can be adapted to different geometries of the rails to be treated and to different metallurgical characteristics/productivity to be achieved.

A companion objective of the present invention is to offer a solution able to restrain the rail both vertically—against rail bending- and also horizontally—against asymmetrical rail bending and rail fluctuation of a roll table-during the thermal process.

A supplemental objective of the present invention is to propose a solution wherein switches between different cooling media are easily and quickly feasible.

The present invention achieves these and other objectives and advantages by the features of a system for thermal treatment of rails comprising:

- cooling means intended to spray a cooling medium onto a rail to be treated, said cooling means defining a cooling path intended to receive the rail to be treated,
- conveying means indented to move the rail to be thermally treated through said cooling path, the system further comprises means for vertically displacing at least one of said cooling means to adjust the position of said cooling means relative to the rail to be treated.

According to other features taken alone or in combination:

- the system further comprises a plurality of cooling supports overlooking, in operation, the conveying means, each cooling support carrying at least one of said cooling means;
- the system comprises securing means for releasably securing each cooling support to said vertically displacing means;
- the securing means are adapted and located in order to secure alternatively different cooling supports with different types of cooling means able to spray different kinds of cooling media to the vertically displacing means;
- the system further comprises a first cooling block comprising a first set of cooling supports linked together, said first cooling block being connectable to said vertically displacing means to form said cooling path, said first cooling block being interchangeable with at least one second cooling block comprising a second set of cooling supports linked together by second pipes to supply a second type of cooling means, said second cooling block being also connectable to said same vertically displacing means to form said cooling path;
- the means for vertically displacing at least one of said cooling means comprise:
  - i. at least one deformable parallelogram comprising a plurality of sides and having one of said side fix,
  - ii. a plurality of supporting arms, each supporting arm being linked to said at least one articulated parallelogram,
  - iii. driving means secured to said at least one deformable parallelogram, actuation of said driving means provoking deformation of said at least one deformable parallelogram and vertical translation of at least one supporting arm.
- the means for vertically displacing each cooling means comprise at least two deformable parallelograms secured together by means of at least one beam, said driving means being secured to said beam and being able to translate both deformable parallelograms;
- each deformable parallelogram is secured to a linking shaft, said linking shaft being received in a flange of each supporting arm, said linking shaft connecting the supporting arms ones to the others;
- the system comprises means for reversibly rotating at least one cooling support between a working position wherein said cooling support is located above the conveying means and a non-working position wherein each cooling support is located beside the conveying means;
- the system comprises guiding means to guide the rail during its conveying, said guiding means comprising:
  - at least one guiding shaft,
  - at least one guiding wheel connected to said guiding shaft, said guiding wheel comprising a first and a second half-wheel, each half-wheel being free to rotate relative to the other and free to rotate about said guiding shaft;

at least one guiding wheel is designed and dimensioned such that during rail guiding, each first half-wheel contacts the rail on the feet and second half-wheel on the web to maintain the rail in a predefined position;

at least two of said guiding wheels are located in a plane perpendicular to the path of the rail;

each guiding wheels is chosen between two kinds of wheels only;

the system comprises means for reversibly rotating at least one guiding shaft and the corresponding guiding wheel between a working position wherein said guiding wheel is able to contact the rail to be thermally treated and a non-working position wherein said guiding wheel is not anymore able to contact the rail.

BRIEF DESCRIPTION OF THE SEVERAL VIEWS OF THE DRAWING

Other objectives, features and advantages of the present invention will be now described in greater details with reference to the drawings, wherein.

DESCRIPTION OF THE INVENTION

Figure 1:
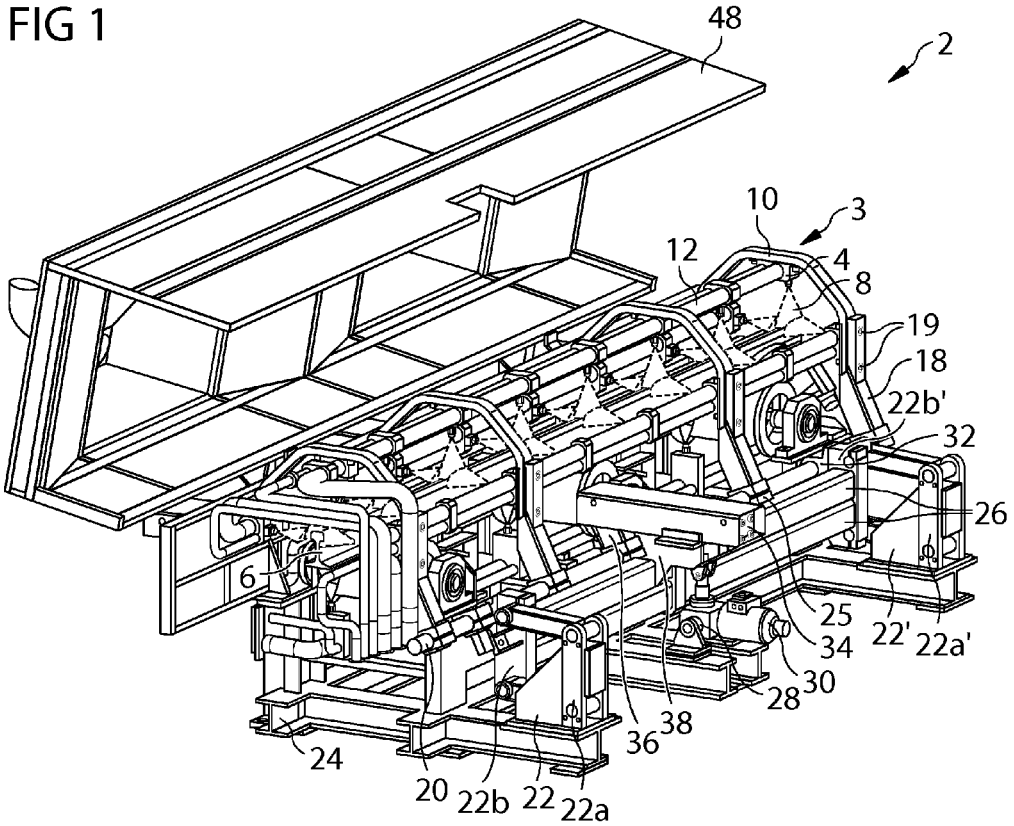
FIG. 1 is a 3D view of a thermal treatment system according to an embodiment of the invention.

In the figures, like reference numerals depict like elements.

FIG. 1 shows a 3D view of a system 2 for thermal treatment of rails according to a possible embodiment of the invention. In this embodiment, the system comprises a plurality of cooling means 4 defining a cooling path through which a rail 6 is moved forward.

In operation, and as can be seen on FIGS. 1-3,6 and 8, the cooling means are spraying a cooling medium 8 onto the rail for cooling a specific part of the rail, head or feet for example.

Each cooling means 4 is secured to a cooling support or ramp 10. In the embodiment of FIG. 1, each cooling support has a C shape and carries three cooling means angularly spaced apart, for example by 90°. Each cooling support 10 and its respective cooling means form what it called a cooling module 5. In the embodiment of the figures, a cooling module 5 comprises three cooling means 4 located in such a way to spray the cooling medium 8 on the top of the rail head and on each side of said head.

Furthermore, in the embodiment shown in FIG. 1, the system according to the invention comprises four cooling modules, but the number of cooling modules can be adapted depending on the rail to be treated.

It has also to be noted that for sake of clarity references have been added on FIG. 1 mainly only in relation with one cooling module, on the right hand side of the figure. Of course a reference used for one given element of this cooling module also applies for any similar element of any other three cooling modules shown in FIG. 1.

In the working position shown in FIG. 1, the system according to the invention comprises a plurality of cooling modules 5 aligned longitudinally to form the cooling path through which the rail is conducted. Each cooling module 5 overlooks the cooling path the rail is intended to follow.

Each cooling support or ramp 10 also supports feeding pipes 12 to which the cooling means are connected. For this purpose, a plurality of maintaining flanges 14 (see FIGS. 2-4) defining passages receiving said pipes 12 are secured to each cooling support 10 by means of blocking flanges 16 screwed in said cooling supports or ramps 10.

The assembly comprising all feeding pipes linking the cooling modules 5 and the cooling modules themselves forms an integral cooling block 3. As will be explained latter, such a cooling block as above defined is rigid enough to be replaced at once by another cooling block able to spray a different cooling medium onto the rail, and this without using additional lifting tool.

The system according to the invention also comprises conveying means to displace the rail to be treated within the cooling path. In the embodiment shown in the figures, the conveying means comprise a plurality of rollers 7 on which rail 6 lies. Each roller has its rotation axis perpendicular to the rail cooling path. The rollers 7 can be driven by one or a plurality of motors.

The system according to the invention further comprises means to displace vertically each cooling means 4 and each cooling support 10, and in a preferred embodiment only the cooling means located above the cooling path or above the conveying means during operation of the system. These displacing means comprise a plurality of supporting arms 18. Each supporting arm 18 is releasably secured to a cooling support 10 by means of securing means. In the embodiment of the figures, the securing means comprise securing screws 19 received in passages defined in each supporting arm 18 and in each cooling support 10. Each supporting arm 18 comprises at one of its extremities a flange 25 receiving a horizontal linking shaft 20. This means that each supporting arm 18 is fixedly secured to said linking shaft. Furthermore, said liking shaft 20 extends parallel to the rail cooling path and connect the supporting arms 18 ones to the others.

The displacing means also comprise two horizontally spaced apart deformable parallelograms 22, 22'. One side 22*a*, 22*a*' of each parallelogram being fixedly secured to a supporting structure 24. Each deformable parallelogram 22,22' extends in a plane perpendicular to the rail cooling path. Two linking beams 26 extend horizontally between mobile vertical sides 22*b* and 22*b*' (parallel to fix sides 22*a* and 22*b*) of each deformable parallelogram in order to fixedly secured them together. Each mobile vertical side 22*b*,22*b*' is fixedly secured to a bearing 32 (called parallelogram's bearing for sake of clarity) which also receives linking shaft 20.

The vertical displacing means also comprise a driving actuator intended to displace the parallelograms. In one embodiment, this driving actuator is a screw jack 28 driven by a motor 30. The screw jack 28 is secured to one of the horizontal linking beam 26.

Actuation of the screw jack 28 provokes a vertical translation of mobile parallelogram vertical sides 22*b* and 22*b*' of each deformable parallelogram 22 and 22', which in turn vertically translate horizontal linking shaft 20, supporting arms 18 and cooling supports or ramps 10 with the cooling means 4 and the feeding pipes 12.

Figure 2:
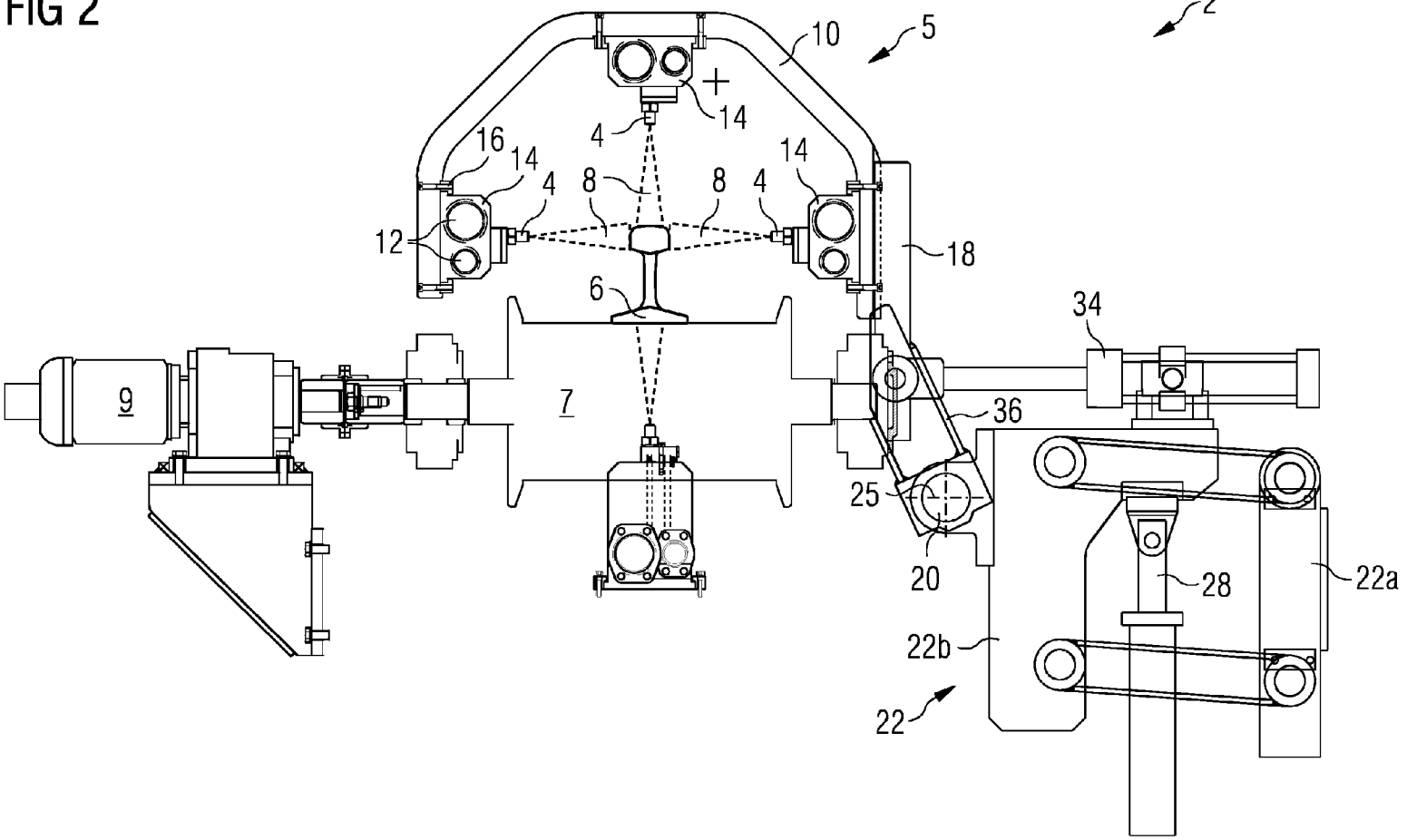
FIG. 2 is a transversal and partial cross section of FIG. 1 showing the cooling means in a first working position.

FIG. 2 shows a situation wherein the system according to the invention is in a raised working position to treat a first type of rail 6.

Figure 3:
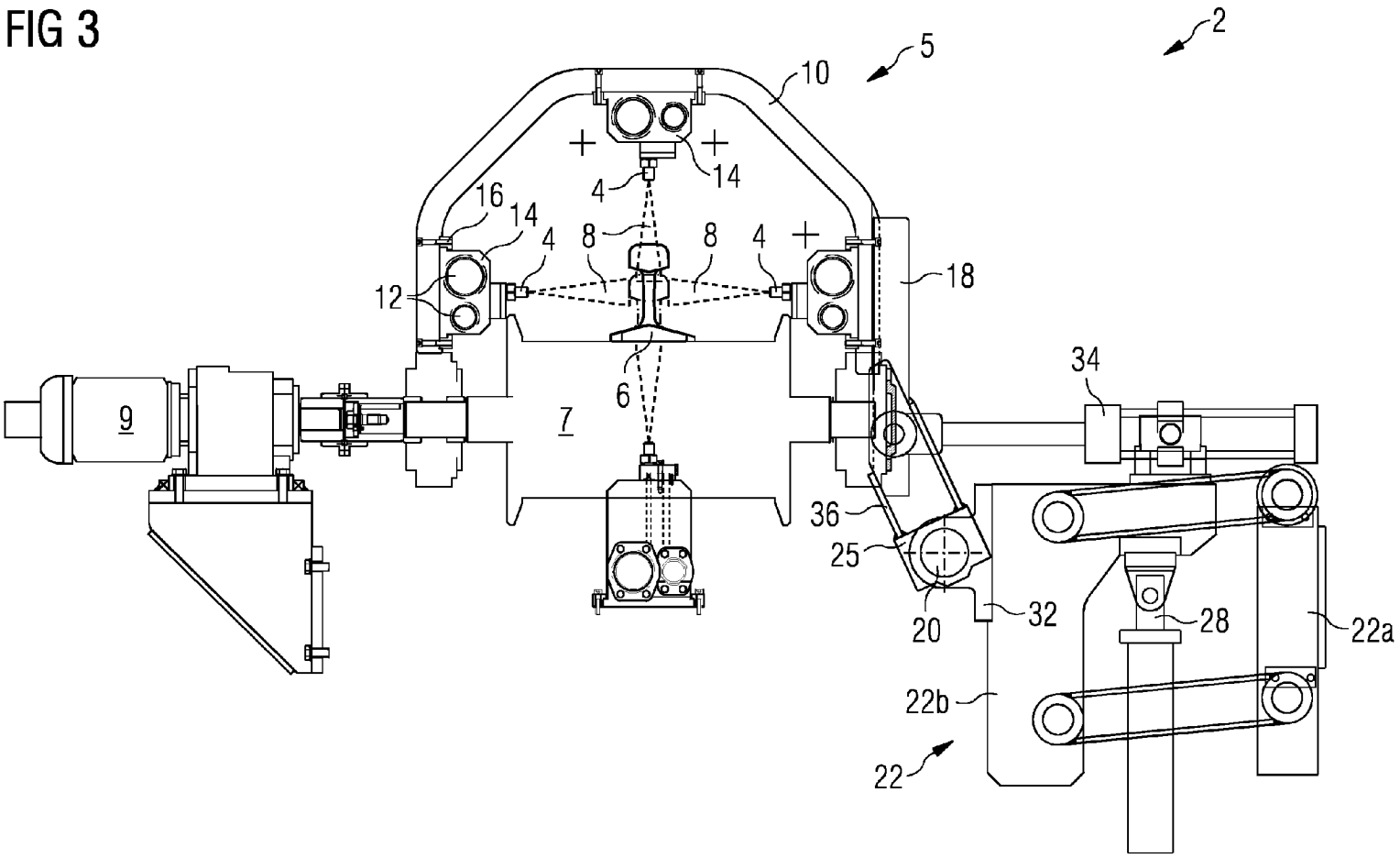
FIG. 3 is a transversal cross section of FIG. 1 showing the cooling means in a second working position.

FIG. 3 is view similar to FIG. 2 wherein the system according to the invention is in a lowered working position to treat a second different type of rail 6. Two types of rail 6 with different height are represented in this figure to illustrate difference of vertical level that can be achieved with the invention. As an example, the system of the invention can vertically translate the cooling means by at least 75 mm The system according to the invention also comprises optional means to retract the cooling means 4. These retracted means may comprise a horizontal retracting jack or cylinder 34. Cylinder 34 is secured to the horizontal linking shaft 20 by means of a retracting arm 36 fixedly secured to the horizontal linking shaft 20 by means of a flange. Said cylinder 34 is carried by and secured to a platform 38, said platform being in turn secured the upper linking beam 26.

When actuated, the retracting cylinder 34 pulls retracting arm 36 which in turn rotates the horizontal linking shaft 20. The horizontal shaft 20 rotates in and relative to parallelogram's bearing 32. This rotation also drives supporting arms 18, and all the cooling modules 5.

Figure 4:
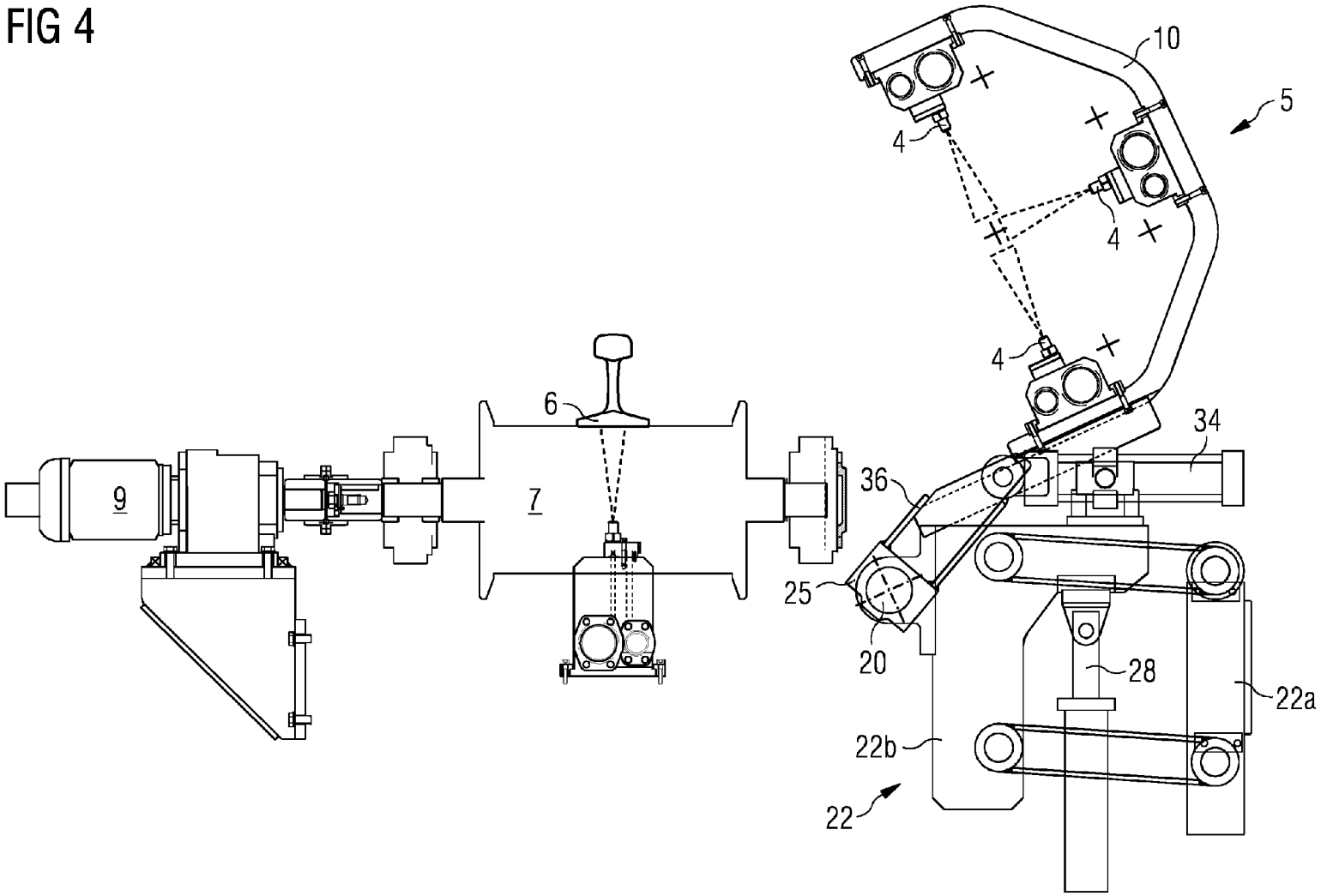
FIG. 4 is a transversal cross section of FIG. 1 showing the cooling means in a non-working position, FIG. 5 are 2D and 3D view of an embodiment of the means guiding the rails during the thermal treatment.

The retracting means can reversibly rotate the cooling modules 5 from a working position shown in FIGS. 2 and 3, wherein the cooling means 4 are located above the conveying means 7, to a non-working position or tilted position shown in FIG. 4 wherein each cooling means is located beside the conveying means, thus allowing an easy access to the cooling means 4 for maintenance operators.

As previously mentioned, different type of cooling means can be used in the system 2 according to the invention, depending of the type of rails to be treated and the expected results. For example, the cooling means of a cooling block can be nozzles spraying water and air or can be air blades. More precisely and as can be seen on FIG. 8, a cooling block can comprise a plurality of cooling supports 10 supporting nozzles 8 spraying water and air or a plurality of cooling support 10' supporting air blades 8' spraying only air.

The system according to the invention is therefore designed such that a complete cooling block as above defined can be quickly (substitution can be made in ¼ of hour) exchanged with another type of block. For this purpose, the connection of each cooling block are standardised to correspond to the connection point with the supporting arms 18 and the distance between the cooling support 10 of each type of cooling block is the same than the distance between the supporting arms 18.

The system 2 according to the invention also comprises a cables chain 40 (see FIG. 6) which hosts, guide and supports the flexible hoses 12 feeding each cooling block. In the context of this description a cables chain is an assembly comprising a guide/support for flexible hoses. The system according to the invention is provided in one embodiment with two sorts of feeding pipes 12, water and air, both are fed by the same cables chain.

Both types of above mentioned cooling blocks have the same kind of connections with the cables chain 40 and with the supporting arms 18. This allows easy and quick interchanges between cooling blocks, which in turn allows an improved flexibility as rail with different steel grades and different metallurgical characteristics can thus be obtained.

The pipe chain 40 is designed in order to accommodate both pipes necessary for air/water type cooling blocks and air blade type cooling blocks in order to allow fast change of the cooling support from water/air type to air blade type and vice versa. The use of flexible feeding pipes allows the vertical adjustment and the tilting of the cooling blocks. This can be seen in FIG. 6 where two different positions of the cables chain 40 are shown, one position in continuous line, and the other one in dotted line. The pipes for these two types of cooling blocks 3 are different, but their connection means with the pipe chain 40 are similar. When the feeding pipes of the air blade type cooling block are connected to the pipe chain 40, the air pipes are used at a low percentage of their capacity, given the section of the pipe.

The standardised connection between the different types of cooling blocks and the rest of the system allows a substitution in for example ¼ of hours. This also allows complete flexibility of the system.

The system according to the invention also comprises means to guide the rail during the thermal treatment. These guiding means comprise a plurality of guiding shaft, each shaft receiving a guiding wheel. Each guiding shaft is further secured to a cylinder. Actuation of the cylinder provokes the rotation of the guiding shaft which in turns rotates its corresponding guiding wheel toward or away from the rail.

Figure 5A:
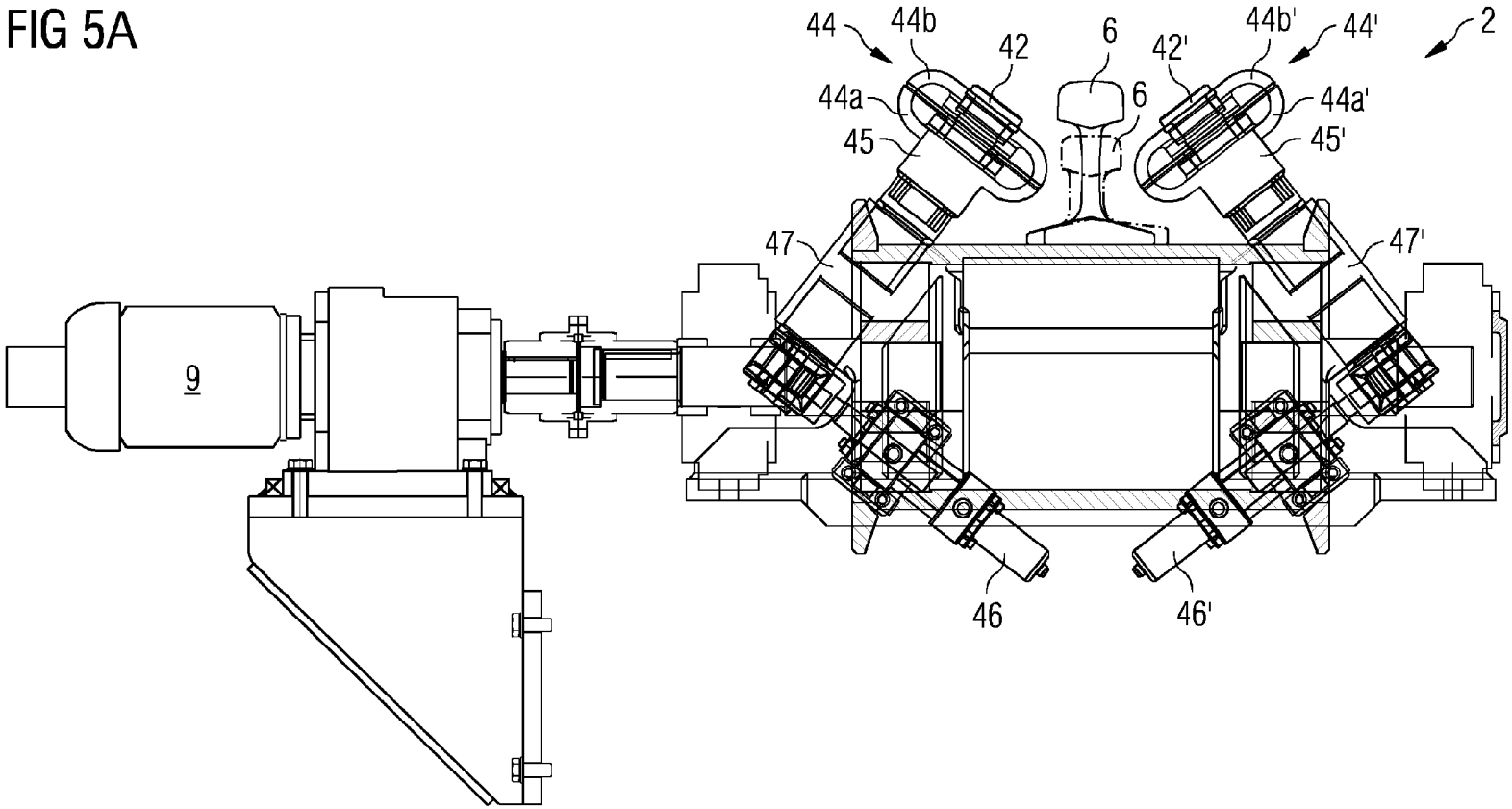
Figure 5B:
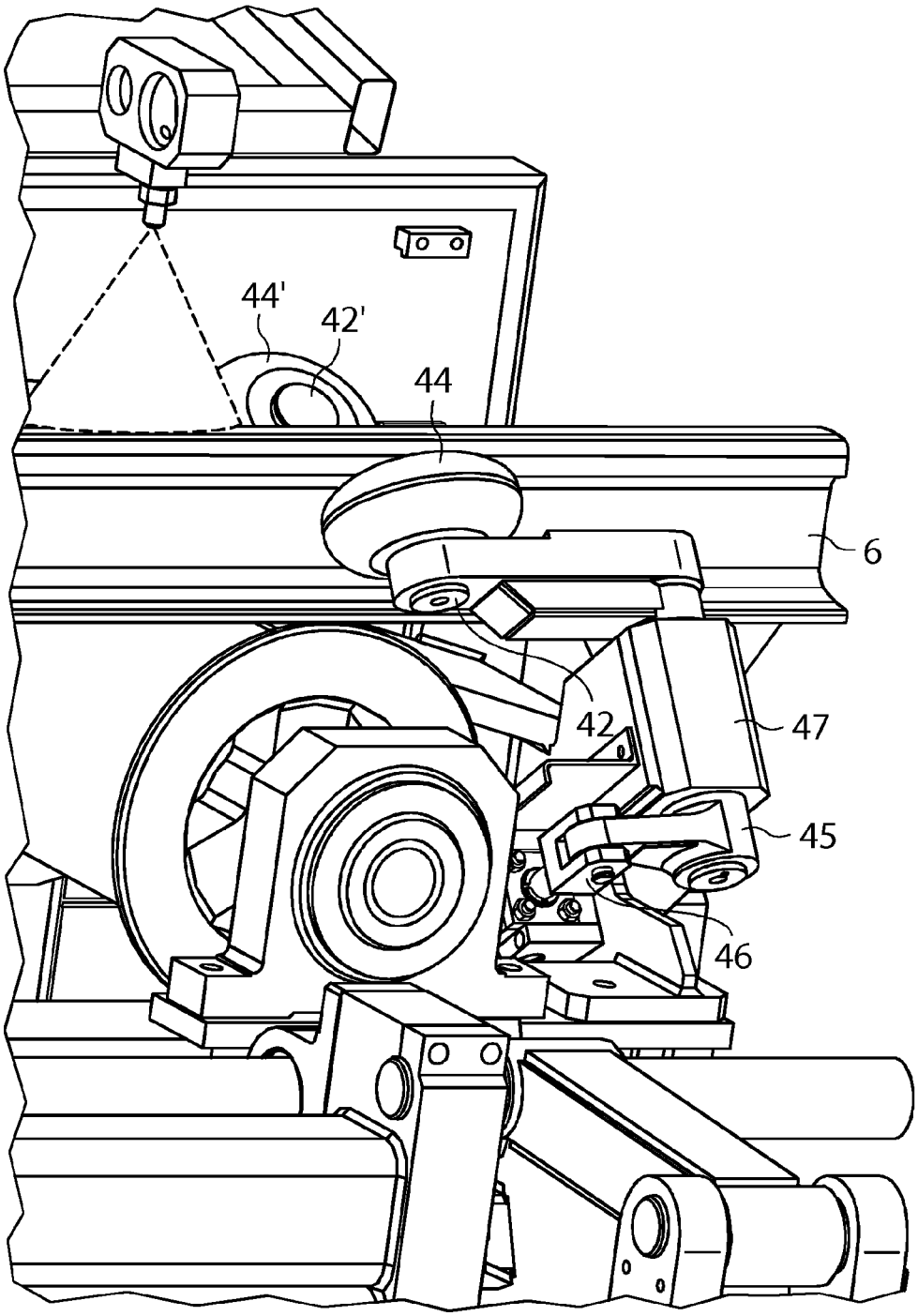
Figure 6:
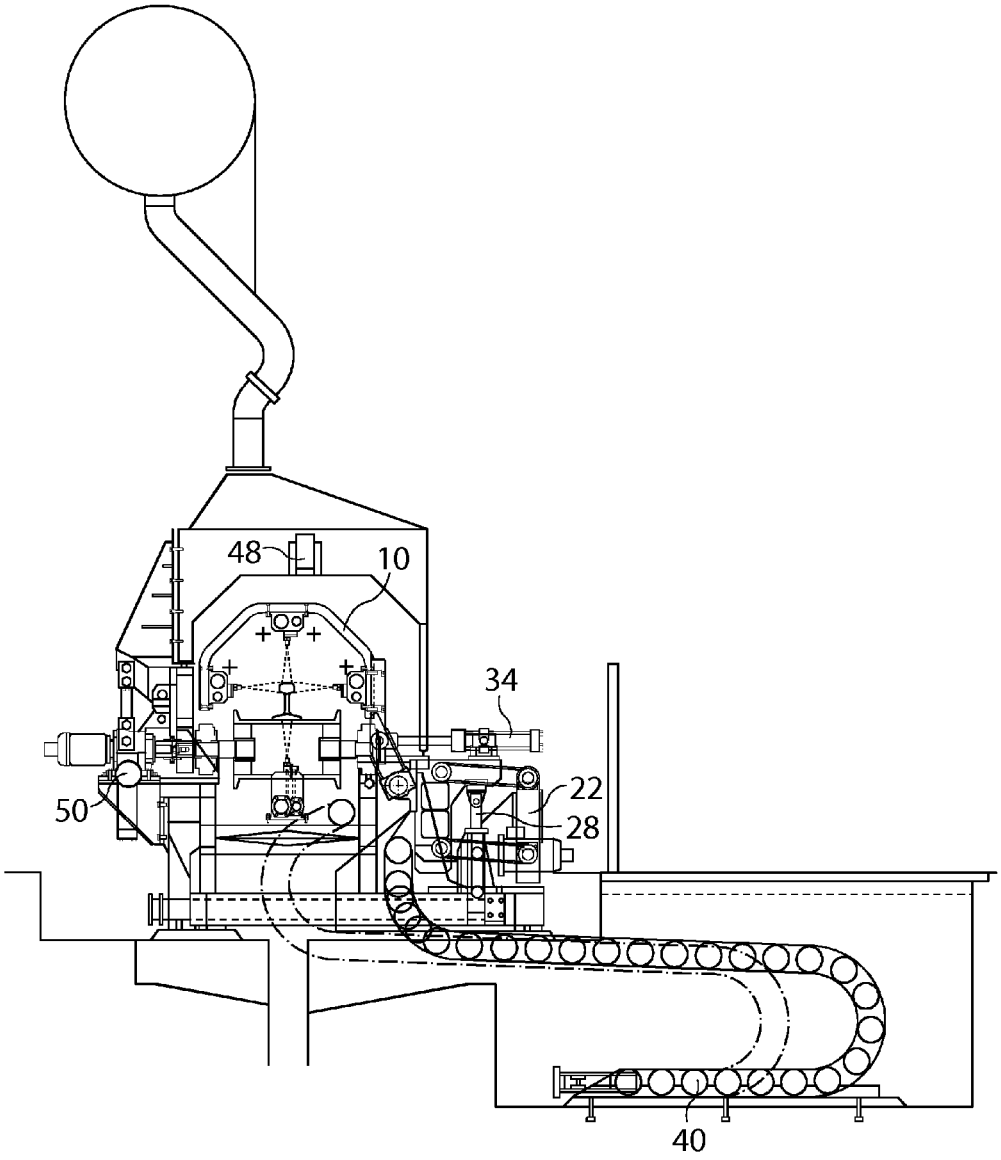
FIG. 6 is a view similar to FIG. 2 showing further details of the system according to the invention, FIG. 7 are cross sections of guiding means according to the invention.
Figure 7A:
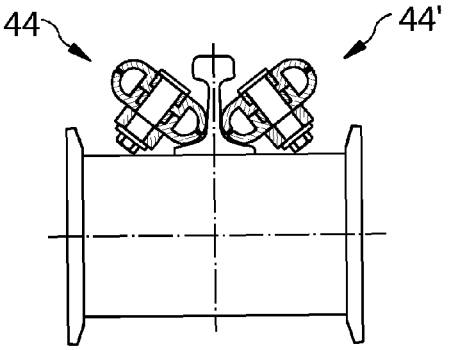
Figure 7B:
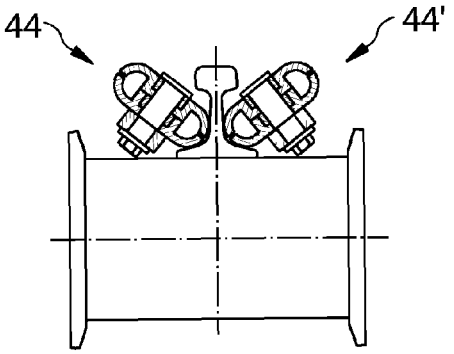
Figure 7C:
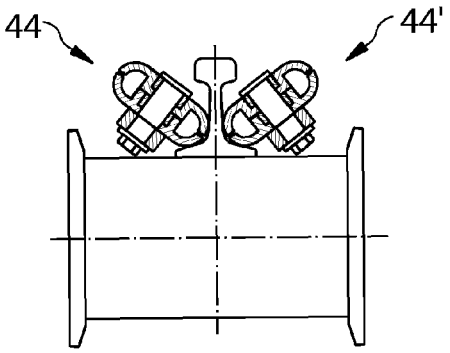
Figure 7D:
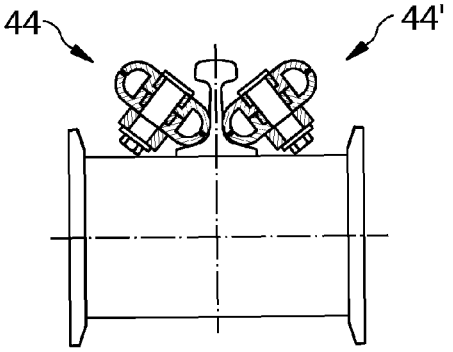
Figure 7E:
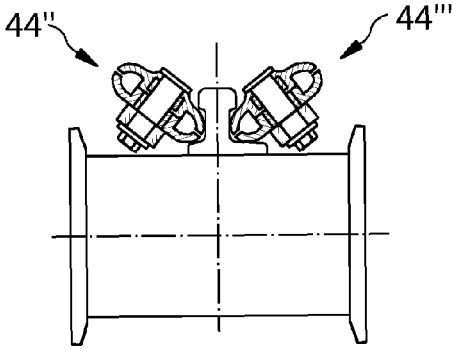
Figure 7F:
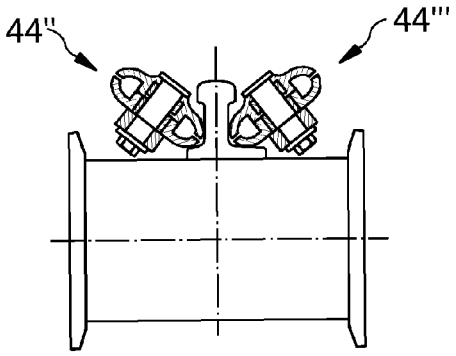
Figure 8:
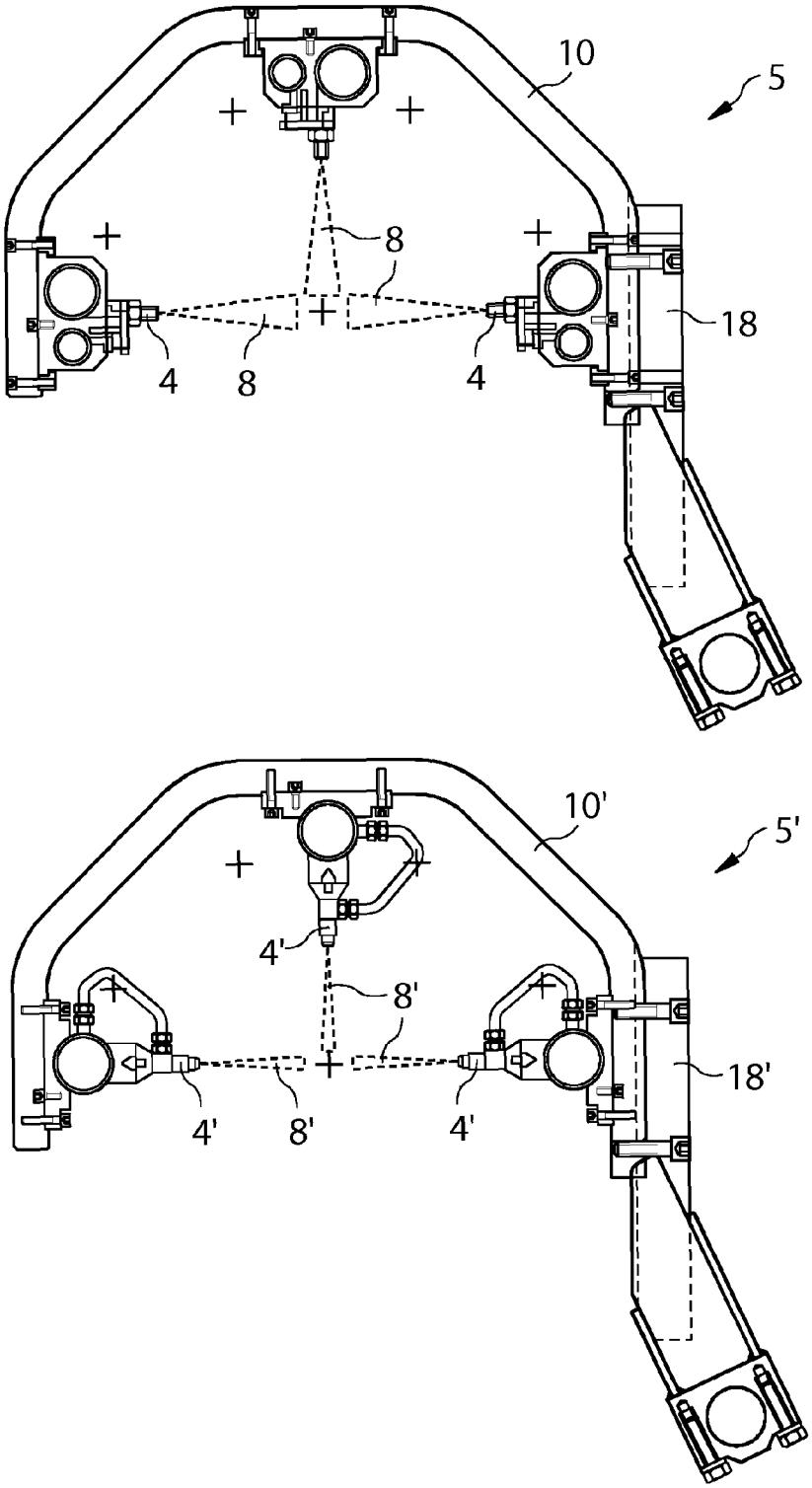
FIG. 8 is a cross section showing different kinds of cooling means used in the system according to the invention.

In the embodiment shown in FIGS. 5*a* and 5*b*, guiding shaft 42 is linked to its corresponding cylinder 46,46' by means of a lever 45,45'. Each lever 45 45' has a C shape and is angled at 45° relative to a horizontal plane. Each lever 45,45' is received in a bearing 47 fixedly secured to the supporting structure 24. Actuation of cylinder 46,46' provokes rotation of lever 45,45' which in turn rotates guiding shaft 42,42' and guiding wheel 44 around the inclined axis of the bearing 47. Furthermore, rotation of the lever 45,45' about said inclined axis, also allows the opening of the guiding means in case of a severally bended rail without damaging to the system according to the invention (both the guiding means and the cooling system).

Each guiding wheel 44 is idler (free to rotate about shaft 42,42') and is divided in a first 44*a*, 44*a'* and a second 44*b*,44*b'* half-wheel. Each half-wheel 44*a*, 44*a'*,44*b*,44*b'* is free to rotate relative to its other corresponding half-wheel and free to rotate about its guiding shaft 42, 42'.

Each guiding wheel 44, 44' has a profile designed such that to be in contact with the upper part of the foot and with the web which are the less critical parts of the rails. Furthermore, during the thermal treatment, the rail has a constant speed, therefore the two points of contact of the rail and each wheel 44, 44' have the same tangential speed but may be located at a different distance from the centre of the corresponding wheel. This means a different radius and therefore different angular speed for the two wheels 44,44', and therefore undesirable friction points. This difference of speed problem is solved by the fact that each half wheel 44*a*,44*b*,44*a'*,44*b* is free to rotate one relative to the other about the axis of the guiding wheel.

Cylinder 46,46' is provided to adapt the position of each guiding wheel 44, 44' to different rail profiles by rotating said wheel 44, 44' such that they contact the rail. In this manner, guiding wheels 44, 44' guide the rail vertically and horizontally, via the contacting points between the guiding wheel and the rail.

Furthermore, the fact that each guiding wheel contacts the rail on the upper part of the foot avoid any deviation of the rail in the vertical direction and the fact that the each guiding wheel contact the rail at the web avoid any deviation of the rail in the horizontal. In this manner the rail is guided and kept in correct position during the thermal treatment and all kinds of bending are prevented.

As can be seen in FIG. 5*a* a pairs of assembly each comprising a wheel 44, 44' a guiding shaft 42,42' and a cylinder 46,46' can be located in a plane perpendicular to the rail path. In a preferred embodiment, in operation, and in case of symmetrical rail, each assembly is symmetrically located relative to the other and relative to the vertical median plane of the rail.

FIGS. 7*a*-7*f* show the type of guiding wheels 44,44',44" and 44'" used for rails of different shapes. As this can be seen on FIGS. 7*a* to 7*d* the same type of guiding wheels or rolls are used on both sides of the rail when the rail is symmetrical. In case of an asymmetrical rail, as this is represented on FIGS. 7*e* and 7*f*, the geometry of the guiding wheels is such that each guiding wheel is in contact with the lowest critical parts of the rails, the upper part of the foot and the web. In the latter situation different kinds of guiding wheels with different geometries are used on each side of the rail.

It has to be noted that even though the guiding means are presented in the present description in relation with rail technology, they can be used in all kinds of application where guiding with different angular speeds is needed.

Furthermore, the system according to the invention is equipped with a suction means comprising an overall movable hood 48 (see FIGS. 1 and 8) for reduction of pollution in the area. The hood 48 is tiltable by means of cylinder 50 in order to allow the tilting of the cooling supports 10.

As above shown, the vertical translation implemented via the parallelograms 22, 22' allows a pure vertical movement of the cooling support that will always correctly fit the horizontal distance of the spray system from the head of the rail thus allowing a uniform and symmetrical cooling of the head of the rail for each type of rail (different standards, symmetrical/asymmetrical).

The introduction of completely compatible water/air type ramp and air type ramp allows a reliable and flexible system that can easily fit the different needs of different production lots and different customers.

The rail guiding means are in contact with the rail at the less important portions of the rail and are capable of restraining the rail both vertically (against rail bending) and horizontally (against asymmetrical rail bending and rail fluctuation on the conveying means).

The rail guiding means also keep the head of the rail in the predefined position to maximize the uniformity of the hardening treatment.

The guiding means are adaptable to each type of rail (different standards, symmetrical/asymmetrical) with two profiles only of guiding rolls or wheels (thus allowing low changing operation time and few spares parts). Only for the asymmetrical rail the change of guiding wheel is needed.

The rail guiding system is mechanically self-centring the head of symmetrical rails in the predefined position; therefore no manual or electronic regulation is needed.

The oblique wheels of the rail guiding means are divided into two halves that can rotate independently in order to avoid friction due to the difference of tangential speed of the contact points.

The tilting of the cooling means is designed in order to position the spraying system (both water/air nozzle and air blades) at a height easily accessible by maintenance operators.

All the operations (vertical regulation of the ramps, opening/closing of the tilting system for the ramps, opening/closing of the overhead hood) are automatically operated in order to achieve the fastest and more reliable operation and the lowest possible manual intervention by Operation & Maintenance operators.

The invention claimed is:

1. A system for thermally treating rails, the system comprising:

cooling devices for spraying a cooling medium onto a rail to be treated, said cooling devices defining a cooling path for receiving the rail to be treated;

a conveyor for moving the rail to be thermally treated through said cooling path;

a vertically displacing device for displacing at least one of said cooling devices to adjust a position of said one cooling device relative to the rail to be treated;

a plurality of cooling supports overlooking, in operation, said conveyor, each of said cooling supports carrying at least one of said cooling devices;

a first cooling block having a first set of said cooling supports linked together, said first cooling block being connectable to said vertically displacing device to form said cooling path; and at least one second cooling block having second pipes and a second set of said cooling supports linked together by said second pipes to supply a second type of said cooling device, said first cooling block being interchangeable with said at least one second cooling block, said second cooling block being also connectable to said vertically displacing device to form said cooling path.

2. The system according to claim 1, further comprising securing means for releasably securing each of said cooling supports to said vertically displacing device.

3. The system according to claim 1, wherein said vertically displacing device for vertically displacing said cooling devices, includes:

at least one deformable parallelogram having a plurality of sides and with one of said sides fixed;

a plurality of supporting arms, each of said supporting arms being linked to said at least one deformable parallelogram; and a drive secured to said at least one deformable parallelogram, actuation of said drive provoking deformation of said at least one deformable parallelogram and vertical translation of at least one of said supporting arms.

4. The system according to claim 3, further comprising at least one beam;

wherein said vertically displacing device for vertically displacing said cooling devices has at least two of said deformable parallelograms secured together by means of said at least one beam, said drive being secured to said beam and being able to translate both of said deformable parallelograms.

5. The system according to claim 3, wherein said supporting arms each have a flange;

further comprising a linking shaft; and wherein each said deformable parallelogram is secured to said linking shaft, said linking shaft being received in said flange of each of said supporting arms, said linking shaft connecting said supporting arms to other ones of said supporting arms.

6. The system according to claim 1, further comprising retracting means for moving at least one of said cooling supports between a working position wherein said one cooling support is disposed above said conveyor and a non-working position wherein said one cooling support is disposed beside said conveyor.

7. The system according to claim 1, further comprising a guide to guide the rail during conveying of the rail, said guide comprising:

at least one guiding shaft; and at least one guiding wheel connected to said guiding shaft, said guiding wheel having a first and a second half-wheel, each said half-wheel being free to rotate relative to the other and free to rotate about said guiding shaft.

8. The system according to claim 7, wherein said at least one guiding wheel is configured and dimensioned such that during rail guiding, each said first half-wheel contacts the rail on rail feet and said second half-wheel on a rail web to maintain the rail in a predefined position.

9. The system according to claim 7, wherein said guiding wheel is one of a plurality of guiding wheels, at least two of said guiding wheels are disposed in a plane perpendicular to said cooling path of the rail.

10. The system according to claim 7, wherein said guiding wheel is one of a plurality of guiding wheels.

11. The system according to claim 7, further comprising:

retracting means for moving at least one of said cooling supports between a working position wherein said one cooling support is disposed above said conveyor and a non-working position wherein said one cooling support is disposed beside said conveyor;

said retracting means configured for reversibly rotating said at least one guiding shaft and said guiding wheel between a working position wherein said guiding wheel is able to contact the rail to be thermally treated and a non-working position wherein said guiding wheel is not anymore able to contact the rail.

12. The system according to claim 11, wherein said retracting means comprises:

at least one cylinder; and at least a lever, said lever connecting said cylinder and said guiding shaft, and actuation of said cylinder provoking rotation of said lever which in turn rotates said guiding shaft and said guiding wheel.

13. A system for thermally treating rails, the system comprising:

cooling devices for spraying a cooling medium onto a rail to be treated, said cooling devices defining a cooling path for receiving the rail to be treated;

a conveyor for moving the rail to be thermally treated through said cooling path;

a vertically displacing device for displacing at least one of said cooling devices to adjust a position of said one cooling device relative to the rail to be treated;

a plurality of cooling supports overlooking, in operation, said conveyor, each of said cooling supports carrying at least one of said cooling devices; and retracting means for moving at least one of said cooling supports between a working position wherein said one cooling support is disposed above said conveyor and a non-working position wherein said one cooling support is disposed beside said conveyor.

14. A system for thermally treating rails, the system comprising:

cooling devices for spraying a cooling medium onto a rail to be treated, said cooling devices defining a cooling path for receiving the rail to be treated;

a conveyor for moving the rail to be thermally treated through said cooling path; and a vertically displacing device for displacing at least one of said cooling devices to adjust a position of said one cooling device relative to the rail to be treated;

said vertically displacing device for vertically displacing said cooling devices, including: at least one deformable parallelogram having a plurality of sides and with one of said sides fixed; a plurality of supporting arms, each of said supporting arms being linked to said at least one deformable parallelogram; and a drive secured to said at least one deformable parallelogram, actuation of said drive provoking deformation of said at least one deformable parallelogram and vertical translation of at least one of said supporting arms.

* * * * *